US006578614B1

(12) United States Patent
Loewenthal

(10) Patent No.: US 6,578,614 B1
(45) Date of Patent: Jun. 17, 2003

(54) CONVEYOR FOR COMBINING TWO-COMPONENT ITEMS

(75) Inventor: Horst Loewenthal, Waldshut-Tiengen (DE)

(73) Assignee: SIG Pack Systems AG, Beringen (CH)

( * ) Notice: Subject to any disclaimer, the term of this patent is extended or adjusted under 35 U.S.C. 154(b) by 0 days.

(21) Appl. No.: 09/556,980

(22) Filed: Apr. 24, 2000

(30) Foreign Application Priority Data

Apr. 23, 1999 (CH) ..... 0759/99

(51) Int. Cl.[7] ..... B67B 1/00; B65H 29/16; B65H 29/10

(52) U.S. Cl. ..... 156/358; 156/363; 156/378; 156/423; 156/556; 156/566; 156/578; 198/572; 198/575; 198/597; 53/264; 53/489

(58) Field of Search ..... 156/378, 556, 156/356, 363, 367, 379, 423, 566, 578, 580, 358; 53/264, 489; 198/572, 575, 597

(56) References Cited

U.S. PATENT DOCUMENTS 3,432,989 A * 3/1969 Bouzereau ..... 53/264
3,680,678 A 8/1972 Ganz
3,750,256 A 8/1973 Elmer
3,884,177 A 5/1975 Brink et al.
4,172,514 A 10/1979 Shantz et al.
4,663,913 A 5/1987 Trendel
5,493,849 A * 2/1996 Itoh ..... 493/108

FOREIGN PATENT DOCUMENTS

| | | |
|---|---|---|
| DE | 43 31 725 | 3/1995 |
| EP | 0 347 392 | 12/1989 |
| GB | 2 260 742 | 4/1993 |

* cited by examiner

*Primary Examiner*—Richard Crispino
*Assistant Examiner*—Cheryl N. Hawkins
(74) *Attorney, Agent, or Firm*—Venable LLP; Robert Kinberg; Chad C. Anderson

(57) ABSTRACT

An apparatus for advancing and uniting first and second components into respective single items, includes a first conveyor for supplying the first components in a series; a feeding device for supplying the second components in a series; a second conveyor adjoining the discharge end of the first conveyor; a plurality of first carriers mounted on the second conveyor for receiving a respective first component from the first conveyor at the discharge end thereof; and a plurality of second carriers mounted on the second conveyor for receiving a respective second component from the feeding device. The second carriers are in alignment with the respective first carriers for advancing the respective first components and the respective second components together and in alignment with one another; and a device for uniting a first component with a respective second component during advancement of the first and second components by the second conveyor.

10 Claims, 3 Drawing Sheets

1
2
3
10
11
12
13
14
15
17
18
19
20
21
22
27
28
29
45
46
52
53
54
56
61
62
64
65
66
71
74
75
76

CONVEYOR FOR COMBINING TWO-COMPONENT ITEMS

CROSS REFERENCE TO RELATED APPLICATION

This application claims the priority of Swiss Application No. 0759/99 filed Apr. 23, 1999, which is incorporated herein by reference.

BACKGROUND OF THE INVENTION

This invention relates to a conveyor which separately advances and unites the two components of a two-part item.

U.K. Published Patent Application 2,260,742 discloses an apparatus for inserting bottle closures on filled bottles. The bottles are cyclically conveyed by a first conveyor in a group of six. A second, circulating conveyor periodically readies six closures parallel to the first conveyor. The closures are subsequently transferred to six setting heads which place the closures on the bottles. This conventional apparatus is relatively slow because of its intermittent operation.

SUMMARY OF THE INVENTION

It is an object of the invention to provide an apparatus of the above-outlined type with which two components of items to be subsequently packaged may be united in an efficient manner.

This object and others to become apparent as the specification progresses, are accomplished by the invention, according to which, briefly stated, the apparatus for advancing and uniting first and second components into respective single items, includes a first conveyor for supplying the first components in a series; a feeding device for supplying the second components in a series; a second conveyor adjoining the discharge end of the first conveyor; a plurality of first carriers mounted on the second conveyor for receiving a respective first component from the first conveyor at the discharge end thereof; and a plurality of second carriers mounted on the second conveyor for receiving a respective second component from the feeding device. The second carriers are paired with the respective first carriers for advancing the respective first components and the respective second components together and in alignment with one another; and a device for uniting a first component with a respective second component during advancement of the first and second components by the second conveyor.

DESCRIPTION OF THE PREFERRED EMBODIMENTS

Figure 1:
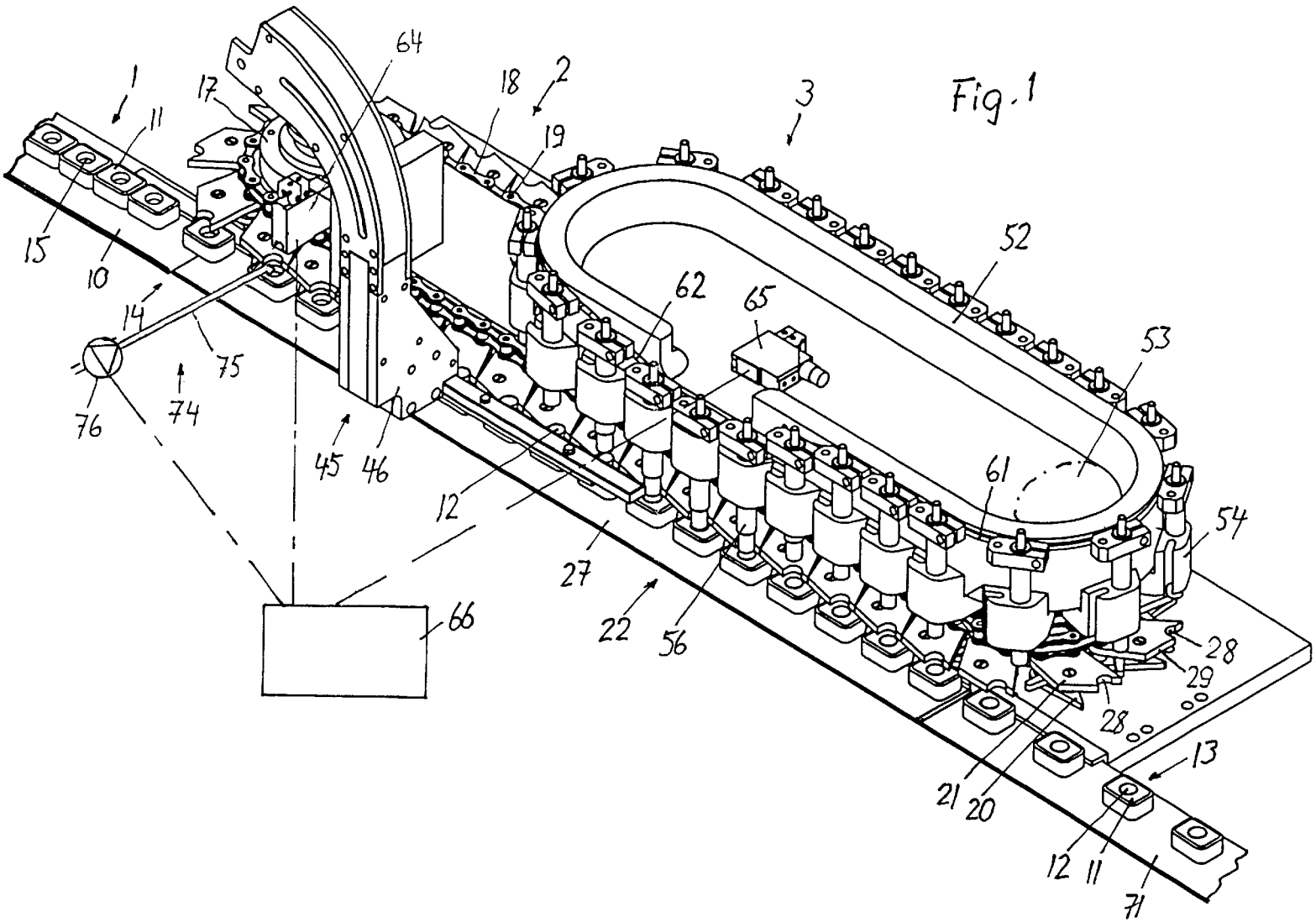
FIG. 1 is a perspective view of a preferred embodiment of the invention.

Turning to FIG. 1, the apparatus shown therein has a first conveyor 1, a second conveyor 2 and a third conveyor 3. The conveyor 1 may be, for example, a circulating conveyor belt 10 on which rectangular first components 11 of an item 13 eventually to be formed of two components 11 and 12 are conveyed in a column in which the components 11 are in a contacting series. The conveyor 1 delivers the components 11 to a transfer station 14 where the components are moved onto the second conveyor 2. The components 11 have a blind bore 15 on the top for subsequently receiving the second component 12.

The second conveyor 2 is formed of an endless chain 18 guided about two end sprockets 17 (only one is visible in FIG. 1). One of the sprockets 17 is rotated by a non-illustrated motor and is coupled with an angular position sensor. As also shown in FIGS. 2–6, between adjoining chain pins 19 of the chain 18, there are provided, vertically spaced from one another, a lower carrier 20 for advancing the components 11 and an upper carrier 21 for advancing the components 12. The chain pins 19 are extended beyond the lower carrier 20 and are guided in a guide groove 23 of a guide rail 24 (cam track), as shown in FIG. 4.

Each carrier 20 has an end face 26 oriented in and being perpendicular to, the conveying direction A for pushing the items 13 along a slide 27. The carrier 20 is wedge-shaped and positions itself at the transfer station 14 in each instance between a leading, engaged component 11 and a successive, trailing component 11. For this purpose, a non-illustrated guide plate is arranged at the transfer station 14, on its side oriented away from the conveyor 2.

Each carrier 21 has a semicircular recess 28 which is adjoined by an end face 29 oriented obliquely to the conveying direction A. As it may be well observed, for example, in FIG. 4, along the working track 22 the face 29 of a leading carrier 21 adjoins.in a coplanar relationship a short surface 30 which forms part of a trailing carrier 21 and which adjoins the semicircular recess 28 thereof.

A two-arm ejecting lever 34 is pivotally mounted on a chain pin 19 between two carriers 20 and 21. A pin 36 which is attached to and extends downward from the free end of one of the arms 35 is guided in a further guide groove 37 of the rail 24. A switch 38 having a groove 39 is arranged in the groove 37 and, in its switch position shown in FIG. 4, forms a linear continuation of the-groove 37. In the switch position of the switch 38 illustrated in FIG. 5, on the other hand, the groove 39 leads into a third groove 40 which extends parallel to the groove 37 and its right-hand length portion 43 (as viewed in the conveying direction A) merges back into the groove 37. Consequently, in the switch position shown in FIG. 5 the ejection lever 34 passing over the switch 38 is pivoted and, as a result, the second arm 41 of the ejection lever 34 laterally pushes away (ejects) a successive item 13 if determined to be defective. The switch 38 is operated by a motor 42.

In the alternative, the ejection levers 34 may be omitted and stationary ejection assemblies such as blow nozzles situated above the working track 22 may be used instead.

Figure 3:
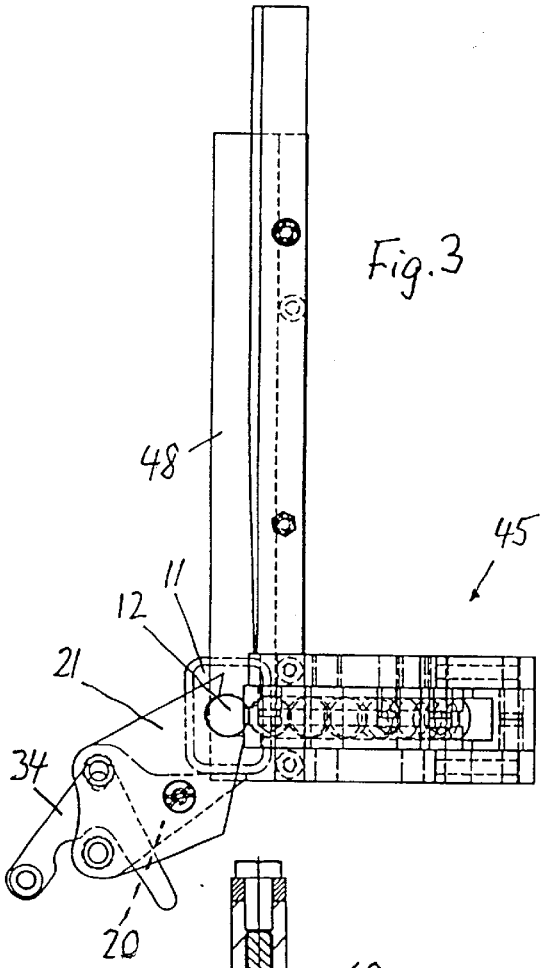
FIG. 3 is a top plan view of the construction shown in FIG. 2.
Figure 2:
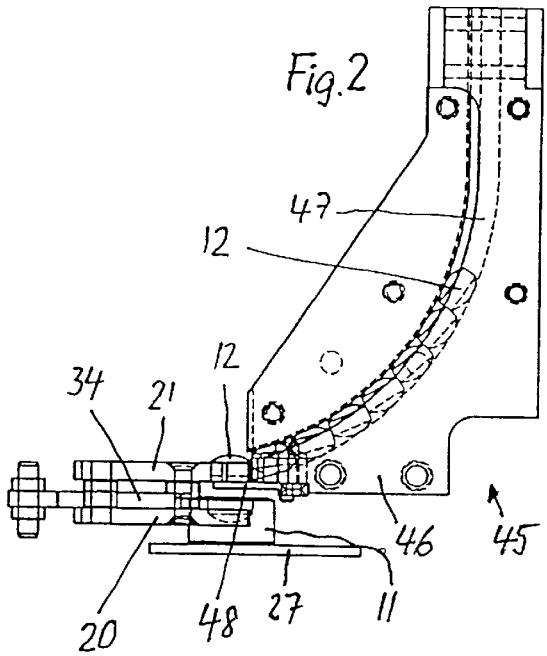
FIG. 2 is a side elevational view of a supply station forming part of the preferred embodiment.
Figure 4:
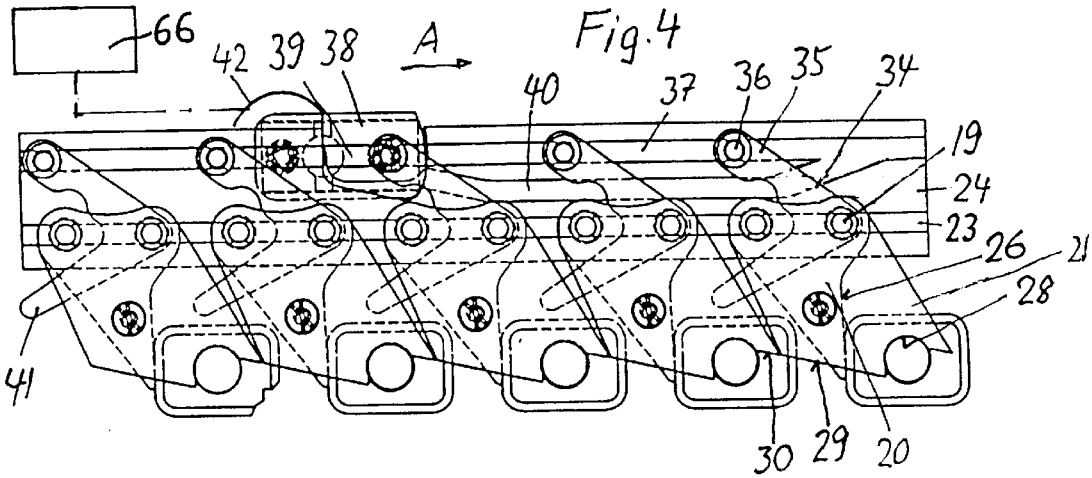
FIGS. 4, 5 and 6 are top plan views of a part of the structure shown in FIG. 1, illustrated in different operational positions.
Figure 5:
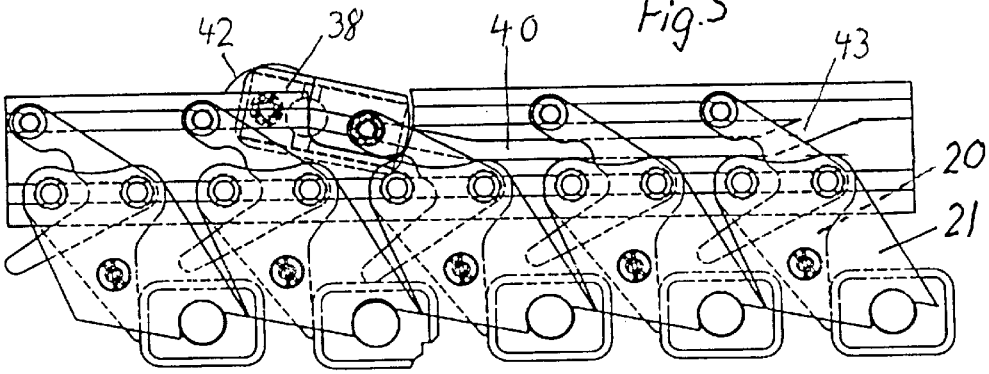
Figure 6:
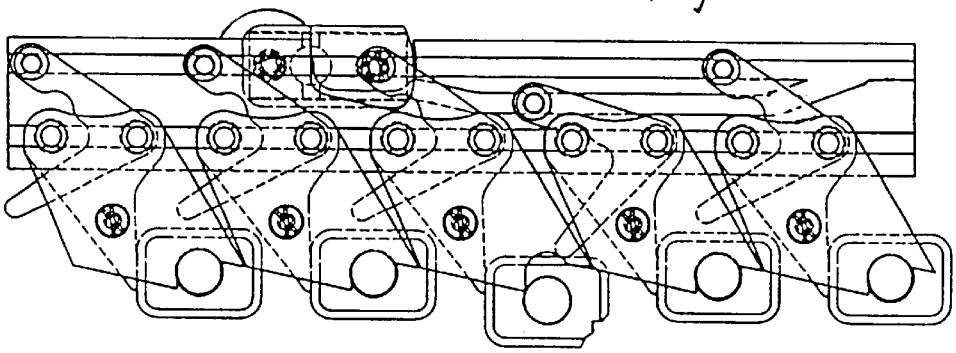

Particularly referring to FIGS. 1, 2 and 3, adjoining the upstream end of the conveyor 2 a feeding device 45 is provided for advancing the second components 12. The feeding device 45 has a channel 47 which is provided in a frame 46 and in which the components 12 are advanced in a column. The channel 47 terminates above a horizontal plate 48 over which the carriers 21 pass. The momentarily leading component 12 is pressed by the successive components 12 in the channel 47 by gravity against the end faces 29, 30 of adjoining carriers 21 and into the immediately adjacent semicircular recess 28. The latter then partially surrounds and entrains the component 12 in such a manner that the component 12 arrives into alignment with the blind bore 15 of the component 11.

The conveyor 3 includes a non-illustrated chain which circulates in a guide 52. The downstream sprocket 53 (symbolically shown in dash-dot lines) of the conveyor 3 may be, for example, affixed to a shaft together with the non-illustrated downstream sprocket of the conveyor 2.

Figure 7:
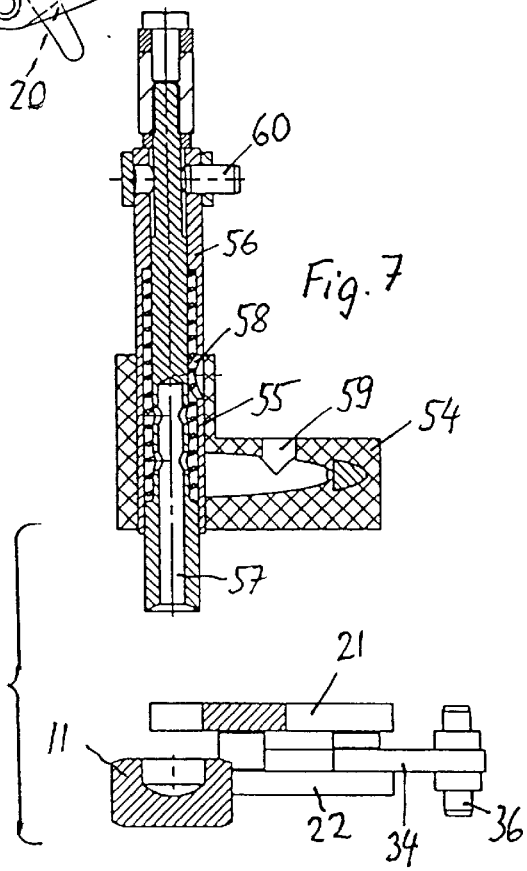
FIGS. 7 and 8 are sectional side elevational views of a component of the preferred embodiment illustrated in two operational positions.
Figure 8:
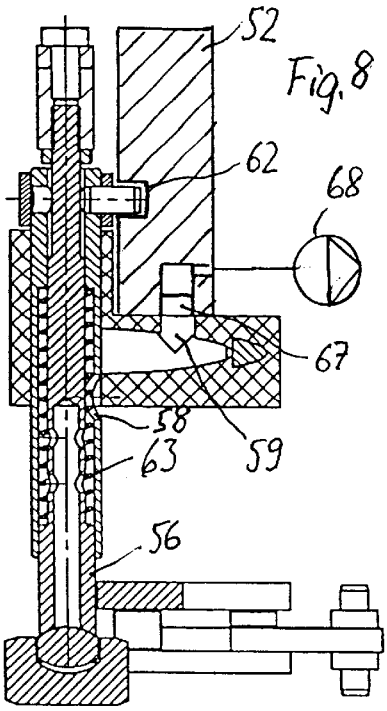

Particularly referring to FIGS. 1, 7 and 8, holders 54 are mounted on the chain of the conveyor 3. Each holder 54 is provided with a vertical bore 55 in which a cylindrical plunger 56 is slidably guided. The plunger 56 has at its bottom a blind bore 57 which, in a mid position of the plunger 56, communicates with a suction coupling 59 of the holder 54 by means of a transverse port 58. A pin 60, mounted on an upper part of the plunger 56, extends transversely to the direction of motion of the plunger 56. The pin 60 is guided in a guide groove 61 of the guide (cam track) 52. The groove 61 has a downwardly inclined portion 62 in the vicinity of the upstream end of the conveyor 3 and an upwardly inclined portion adjacent the downstream end thereof. At the underside of the guide 52, the suction coupling 59 sweeps, for a short distance along the groove portion 62, over a suction port 67 which is provided in the guide 52 and which is coupled with a vacuum source (such as a vacuum pump) 68. The plungers 56 are in an exact alignment with the semicircular recesses 28 of the respective carriers 21 and thus also with the components 12 and the blind bore 15 of the respective components 11. The components 12 are pressed into the blind bore 15 of the respective components 11 between the two inclined portions of the groove 61.

The plate 48 extends up to the inclined portion 62 in such a manner that it terminates at a location where the component 12 has just been caught by the plunger 56. At that moment vacuum is applied to the vacuum coupling 59 and the transverse port 58 is in communication with the suction coupling 59. As a result, the component 12 is drawn by suction to the concave end face of the plunger 56 and thus is accurately guided into the blind bore 15 of the respective component 11. At the end of the downward stroke of the plunger 56 (FIG. 8) the transverse port 58 is closed and thus the suction force on the component 12 is discontinued. The plunger 56 presses the component 12 into the blind bore 15 with a force predetermined by a biased spring 63.

Upstream of the feeding device 45 a further apparatus 74 may by provided for supplying an adhesive droplet into the blind bore 15. The apparatus 74 includes a dispenser tube 75 whose free end terminates above the travel path of the blind bores 15. A periodically operated metering pump 76 delivers the adhesive into the blind bore 15 momentarily aligned with the free end of the dispenser tube 75.

Upstream and downstream of the feeding device 45 respective optical sensors 64, 65 are arranged. The sensor 64 monitors the components 11 to ensure that they are undamaged whereas the sensor 65 verifies the correct positioning of the components 12 in the blind bores 15. The sensor 64 may additionally initiate the correct introduction of an adhesive into the blind bores 15. The sensors 64, 65, the drive motor of the conveyors 2 and 3, the associated rotary angle sensors, as well as the motor 42 of the switch 38 and the pump 76 of the adhesive metering apparatus are connected with a control apparatus 66. In case one of the sensors 64 or 65 responds and indicates an error, the respective switch 38 is, with a delay corresponding to the rotary angle, briefly moved into its position shown in FIG. 5 by the control apparatus 66 for operating an ejection lever 34 which laterally pushes and thus eliminates the defective item 13.

Downstream of the conveyors 1, 2, and 3 the combined items 13, each composed of the respective-components 11 and 12, are conveyed by a conveyor 71 to a packing machine such as a tubular bag packing machine.

The described apparatus makes possible a very gentle handling of the items. It further makes possible a reliable operation at high speeds up to 1200 pieces per minute.

It will be understood that the above description of the present invention is susceptible to various modifications, changes and adaptations, and the same are intended to be comprehended within the meaning and range of equivalents of the appended claims.

What is claimed is:

1. An apparatus for advancing and uniting first and second components into respective single items, comprising:

a first stationary slide plate having an end;

a second stationary slide plate;

a first conveyor for supplying the first components in a series to the second stationary slide plate; said first conveyor having a discharge end;

feeding device for supplying the second components in a series to the first stationary slide plate;

a second conveyor adjoining said discharge end of said first conveyor; said second conveyor having a direction of motion along a working track;

a plurality of first carriers mounted on said second conveyor for receiving a respective first component from said first conveyor at said discharge end thereof and for pushing said first components along the second stationary slide plate;

a plurality of second carriers mounted on said second conveyor for receiving a respective second component from said feeding device by passing over said first stationary slide plate and for pushing said second components along the first stationary slide plate; said second carriers being paired with respective said first carriers for advancing respective first components and respective second components together and in alignment with one another, each second component being paired with a respective first component adjacent the end of the first stationary slide plate; and combining means for uniting said first component with said respective second component during advancement of said first and second components by said second conveyor, wherein the combining means comprises a plurality of pressing devices, each of said pressing devices including a vertically displaceable plunger separate from said first and second carriers, said combining means further comprising a vacuum source, wherein said plunger has a lower end for contacting the second component pushed by said second carrier and having a channel having a first end open at said lower end and a second end communicating with said vacuum source during downward motion of said plunger for accurately guiding the second component.

2. The apparatus as defined in claim 1, wherein said second carriers are disposed over said first carriers and further wherein said combining means comprises (a) moving means for advancing said pressing devices above, in synchronism and in alignment with the first components and respective second components; and (b) control means for operating said pressing devices for pushing the second components into respective first components.

3. The apparatus as defined in claim 2, wherein said moving means comprises a third conveyor.

4. The apparatus as defined in claim 2, wherein each said pressing device includes a follower mounted on said plunger; said control means including a cam track extending along said working track; said follower extending into said cam track.

5. The apparatus as defined in claim 4, wherein said first stationary slide plate extends in said direction of motion of said second conveyor from said feeding device to a location where said plungers are moved downward.

6. The apparatus as defined in claim 1, wherein each said second carrier has a surface oriented obliquely to said direction of motion of said second conveyor and a recess adjoining said surface of said second carrier for partially surrounding a respective second component.

7. The apparatus as defined in claim 1, further comprising a control apparatus; sensor means connected to said control apparatus and disposed along said working track for monitoring the items for defects; and ejecting means operable by said control apparatus for laterally pushing away an item from said second conveyor upon a signal from said sensor means.

8. The apparatus as defined in claim 7, wherein said ejecting means comprises ejection pushers carried by said second conveyor; a respective said ejection pusher being disposed adjacent each pair composed of one of said first carriers-and one of said second carriers.

9. The apparatus as defined in claim 1, further comprising an adhesive metering device positioned upstream of said feeding device as viewed in said direction of motion for delivering an adhesive to a first component momentarily aligned with said adhesive metering device.

10. An apparatus for advancing and uniting first and second components into respective single items, comprising:

(a) a first conveyor for supplying the first components in a series; said first conveyor having a discharge end;

(b) a feeding device for supplying the second components in a series;

(c) a second conveyor adjoining said discharge end of said first conveyor; said second conveyor having a direction of motion along a working track;

(d) a plurality of first carriers mounted on said second conveyor for receiving a respective first component from said first conveyor at said discharge end thereof;

(e) a plurality of second carriers mounted on said second conveyor for receiving a respective second component from said feeding device; said second carriers being paired with respective said first carriers for advancing respective first components and respective second components together and in alignment with one another;

(f) combining means for uniting said, first component with said respective second component during advancement of said first and second components by said first and said second carriers in a rectilinear direction; and (g) a first stationary slide plate having an end and a second stationary slide plate, wherein the feeding device supplies the second components in a series to the first stationary slide plate, wherein the first carriers push the first components along the second stationary slide plate, wherein the second carriers receive the respective second component by passing over the first stationary slide plate, wherein the first and second carriers advance the first and second components by pushing the first and second components, and wherein each second component is paired with a respective first component adjacent the end of the first stationary slide plate.

* * * * *